United States Patent [19]

Chupick

[11] 3,981,114

[45] Sept. 21, 1976

[54] ENERGY ABSORBING PERMANENTLY DEFORMABLE COLLAPSIBLE COLUMN

[75] Inventor: Ronald Chupick, Warren, Mich.

[73] Assignee: General Motors Corporation, Detroit, Mich.

[22] Filed: June 13, 1975

[21] Appl. No.: 586,613

[52] U.S. Cl. ..... 52/232; 52/98; 52/731; 293/DIG. 3; 52/167; 52/301

[51] Int. Cl.[2] ..... E04C 2/00; E04C 3/32

[58] Field of Search ..... 52/98, 99, 232, 731, 52/167; 293/DIG. 3; 188/1 C; 114/219

[56] References Cited

UNITED STATES PATENTS

| | | | |
|---|---|---|---|
| 2,135,749 | 11/1938 | Gallo | 293/DIG. 3 |
| 2,819,060 | 1/1958 | Neidhart | 188/1 C X |
| 3,146,014 | 8/1964 | Kroell | 293/DIG. 3 |
| 3,298,465 | 1/1967 | Stastny | 188/1 C |
| 3,508,633 | 4/1970 | Nishimura et al. | 293/DIG. 3 |
| 3,599,757 | 8/1971 | Takamatsu et al. | 188/1 C |
| 3,718,326 | 2/1973 | Ristau | 114/219 X |
| 3,773,008 | 11/1973 | Guienne et al. | 114/219 |
| 3,863,589 | 2/1975 | Guienne et al. | 114/219 |
| 3,864,922 | 2/1975 | Dial et al. | 114/219 X |
| 3,888,502 | 6/1975 | Felzer et al. | 188/1 C X |

FOREIGN PATENTS OR APPLICATIONS

| | | | |
|---|---|---|---|
| 1,215,193 | 12/1970 | United Kingdom | 293/DIG. 3 |

*Primary Examiner*—Ernest R. Purser
*Assistant Examiner*—Leslie A. Braun
*Attorney, Agent, or Firm*—D. F. Scherer

[57] ABSTRACT

A compound column for absorbing the energy of impact at a controlled rate. The compound column is comprised of an outer column, which collapses at a predetermined rate during the initial phase of energy absorption, and an inner column, which prevents buckling of the outer column during this phase. During the second phase of collapse both columns absorb energy, at a higher predetermined rate, by collapsing simultaneously.

4 Claims, 3 Drawing Figures

ENERGY ABSORBING PERMANENTLY DEFORMABLE COLLAPSIBLE COLUMN

This invention relates to energy absorption structures and more particularly to compound collapsible column structures for energy absorption.

It is a general object of this invention to provide an improved energy absorbing compound column having an initial energy absorbing rate determined by a single collapsible column and a second energy absorbing rate having a value higher than the initial rate determined by two collapsible columns.

A more specific object of this invention is to provide in an improved collapsible column, a frusto-pyramidal shaped outer hollow column providing initial energy absorption and an inner hollow column to prevent buckling of the outer column during the initial phase and providing energy absorption at a controlled rate, with the outer column, during secondary energy absorption.

A further object of this invention is to provide an improved energy absorbing column of compound structure having an outer frusto-pyramidal shaped hollow column and an inner quadrilateral shaped hollow column of substantially one-half the length of the outer column.

These and other objects and advantages will be more apparent from the following description and drawings in which.

Figure 1:
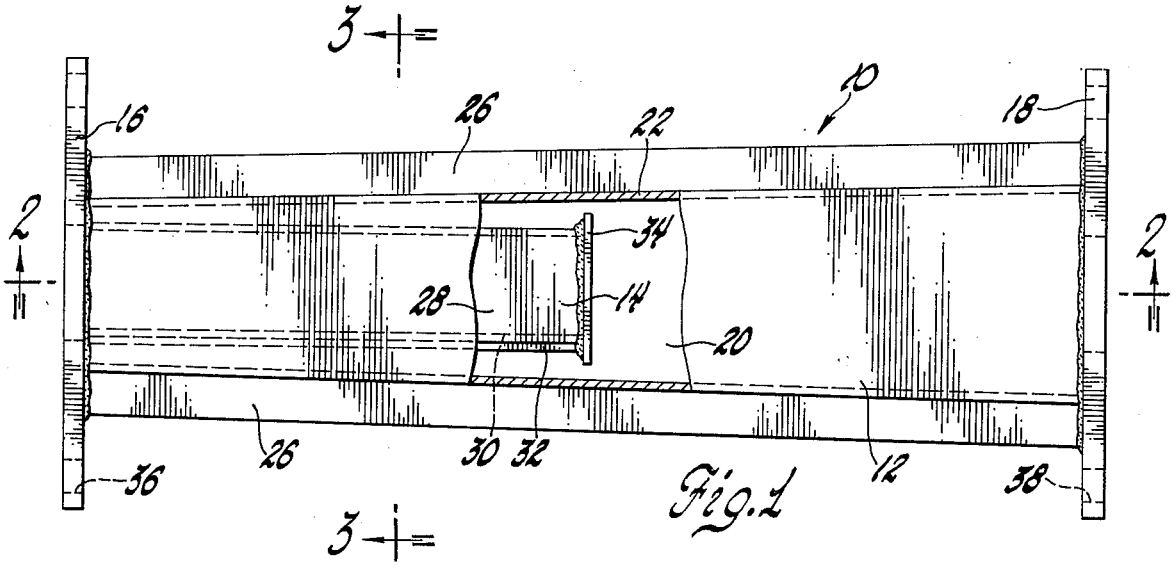
FIG. 1 is a plan view partly in section of an energy absorbing column.
Figure 2:
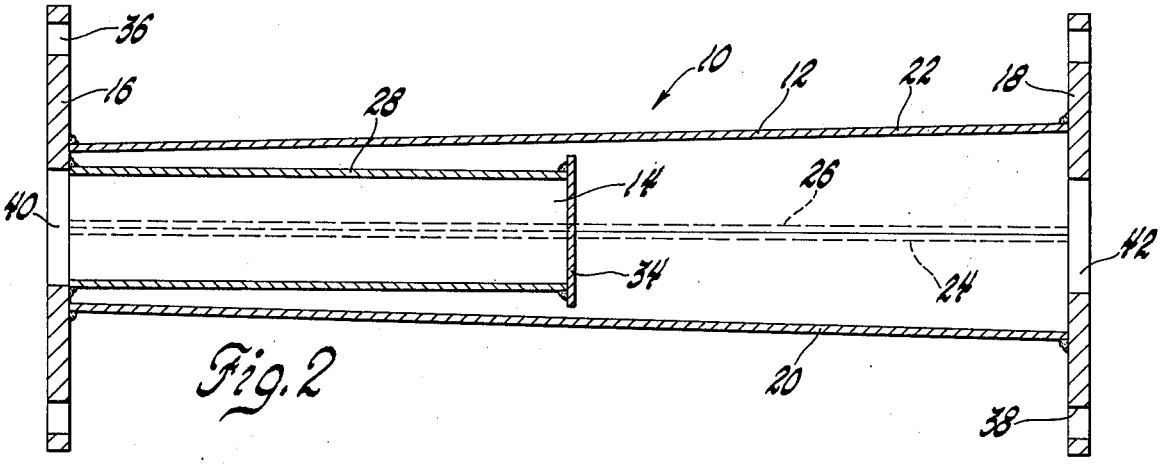
FIG. 2 is a cross-sectional view taken along line 2—2 of FIG. 1.
Figure 3:
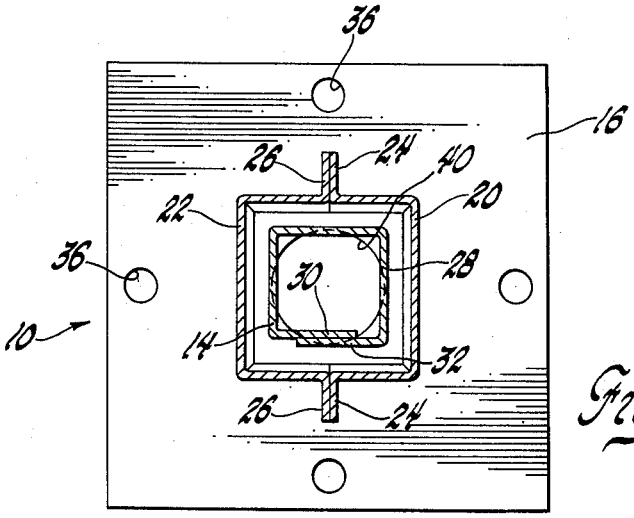
FIG. 3 is a cross-sectional view taken along line 3—3 of FIG. 1.

According to the drawings there is shown a compound column 10 having an outer column 12 and an inner column 14. The outer column 12 is closed at both ends by end caps 16 and 18 which are welded or otherwise bonded to column 12. The column 14 is also welded to end cap 16. As can be seen in FIG. 3, the column 12 is composed of two members 20 and 22 which are mirror images of each other. These members are welded together at flanges 24 and 26 formed on components 20 and 22, respectively. As can be seen in FIGS. 1 and 2, the column 12 is frusto-pyramidal in shape in that it is tapered between end caps 16 and 18 such that the cross-sectional area of the column 12 is increasing from the end cap 16 to end cap 18. The flanges 24 and 26 provide some rigidity to the column 12 such that when the column is mounted in an environment, such as an automobile bumper system, bending about the longitudinal axis of column 12 is restricted.

The inner column 14 is made up of a component which is a flat plate member bent to a quadrilateral shape to form a substantially square post columnar component 28, as seen in FIG. 3. Also as seen in FIG. 3 the component 28 has one side in which ends 30 and 32 are overlapped and the component 28 is then welded along this section to maintain the quadrilateral section shown. The end of component 28, opposite end cap 16, is closed by a flat plate member 34 which is welded to the component 28.

The end cap 16 has formed therein a plurality of openings 36, and the end cap 18 has formed therein a plurality of openings 38. These openings 36 and 38 are provided to permit the column 10 to be assembled in an environment, such as an automobile bumper system, in which controlled collapse is at times desired. Thus, one end of column 12 can be secured by bolts or other means to the bumper and the other end of column 12 can be secured by fasteners to the frame of the automobile. The end caps 16 and 18 have large central openings 40 and 42, respectively, which permit the columns 12 and 14 to be filled with foam. It is well-known that filling a column with foam increases the energy absorbing capacity and rate of a collapsible column. Thus, the column 10 can be used without foam fill in some systems where the desired energy absorption levels are met by the columns 12 and 14, and may be used in systems where higher energy absorption levels are desired by filling the columns 12 and 14 with foam materials. The density of these foam materials, as is well-known, will further expand the range of energy absorption that can be obtained by the column 10.

When the column 10 is collapsed, the initial phase of collapse occurs in column 12. Initially, the column 12 will collapse as end caps 16 and 18 are moved toward each other. In long columns it is known that the column has a tendency to buckle during this collapsing. Should the column 12 attempt to buckle, the inner column 14 will be brought into contact with the interior surface of column 12 to prevent this buckling. After the column 12 has been sufficiently collapsed, the end plate 34 of column 14 will be abutting the end plate 18. Further energy absorption is obtained by the collapse of component 28 and column 12 simultaneously. During this secondary phase of collapse the energy absorption rate is higher due to the fact that both columns must be collapsed simultaneously.

If the column 12 is used to provide vertical support it may be found that the flanges 24 and 26 are not required to support bending loads. In this situation the components 20 and 22 can be simply overlapped and welded together to form the frusto-pyramidal shape desired or the column 12 and be formed in a manner similar to components 28 wherein a single flat plate is bent to form the frusto-pyramidal shape and a single overlap portion is welded to maintain the desired structure.

Obviously many modifications and variations of the present invention are possible in light of the above teaching. It is, therefore, to be understood that within the scope of the appended claims the invention may be practiced otherwise than as specifically described.

What is claimed is:

1. An energy absorbing permanently deformable collapsible column comprising; a frusto-pyramidal shaped first hollow column; a first end cap secured to and closing one end of said first column including attaching means disposed thereon for securing the energy absorbing column in an appropriate environment, a second end cap secured to and closing the other end of said first column including attaching means disposed thereon for securing the energy absorbing column in the appropriate environment; and a second hollow column disposed within said first column having one end secured to said first end cap and having the other end freely disposed at a position substantially one-half the distance between said end caps; said first column being adapted to collapse at a predetermined rate under a predetermined amount of compressive loading, said second column preventing buckling of said first column during initial collapse of said first column and also collapsing at a predetermined rate to increase the load carrying capacity of the energy absorbing column when said first column is sufficiently compressed to permit the second column to contact said second end cap.

2. An energy absorbing permanently deformable collapsible column comprising; a frusto-pyramidal shaped first hollow column; a first end cap secured to and closing one end of said first column, a second end cap secured to and closing the other end of said first column; and a hollow column disposed within said first column having one end secured to said first end cap and having the other end freely disposed at a position substantially one-half the distance between said end caps; said first column being adapted to collapse at a predetermined rate under a predetermined amount of compressive loading, said second column preventing buckling of said first column during initial collapse of said first column and also collapsing at a predetermined rate to increase the load carrying capacity of the energy absorbing column when said first column is sufficiently compressed to permit the freely disposed end of said second column to contact said second end cap.

3. An energy absorbing permanently deformable collapsible column comprising; a frusto-pyramidal hollow column; a first end cap secured to and closing one end of said first column, a second end cap secured to and closing the other end of said first column; a quadrilateral hollow column disposed within said frusto-pyramidal hollow column having one end secured to said first end cap and having the other end freely disposed at a position substantially one-half the distance between said end caps; and a flat plate secured to and closing said freely disposed end of said quadrilateral hollow column; said first column being adapted to collapse at a predetermined rate under a predetermined amount of compressive loading, said second column preventing buckling of said first column during initial collapse of said first column and also collapsing at a predetermined rate to increase the load carrying capacity of the energy absorbing column when said first column is sufficiently compressed to permit the second column to contact said second end cap.

4. An energy absorbing permanently deformable collapsible column comprising; a first hollow column having an increasing cross-sectional area from one end to the other end; a first end cap secured to and closing one end of said first column, a second end cap secured to and closing the other end of said first column, and a second hollow column having a substantially constant cross-sectional area disposed within said first column and having one end secured to said first end cap and having the other end freely disposed at a position intermediate said end caps; said first column being adapted to collapse at a predetermined rate under a compressive load, said second column preventing buckling of said first column during initial collapse of said first column and also collapsing at a predetermined rate to increase the load carrying capacity of the energy absorbing column when said first column is sufficiently compressed to permit the second column to contact said second end cap.

* * * * *